US007102571B2

(12) United States Patent
McCarrick

(10) Patent No.: US 7,102,571 B2
(45) Date of Patent: Sep. 5, 2006

(54) OFFSET STACKED PATCH ANTENNA AND METHOD

(75) Inventor: Charles D. McCarrick, Plymouth, MA (US)

(73) Assignee: KVH Industries, Inc., Middletown, RI (US)

( * ) Notice: Subject to any disclaimer, the term of this patent is extended or adjusted under 35 U.S.C. 154(b) by 0 days.

(21) Appl. No.: 10/290,666

(22) Filed: Nov. 8, 2002

(65) Prior Publication Data

US 2004/0090369 A1 May 13, 2004

(51) Int. Cl.
*H01Q 21/24* (2006.01)

(52) U.S. Cl. ..... 343/700 MS; 343/833

(58) Field of Classification Search ..... 343/700 MS, 343/833, 757, 846; 342/368
See application file for complete search history.

(56) References Cited

U.S. PATENT DOCUMENTS

| | | | | |
|---|---|---|---|---|
| 2,508,085 | A | 5/1950 | Alford | 343/769 |
| 4,370,657 | A | 1/1983 | Kaloi | |
| 4,686,535 | A | 8/1987 | Lalezari | |
| 4,853,657 | A | 8/1989 | Cruchon et al. | 333/21 A |
| 5,008,681 | A | 4/1991 | Cavallaro et al. | |
| 5,166,693 | A | 11/1992 | Nishikawa et al. | |
| 5,181,042 | A | 1/1993 | Kaise et al. | |
| 5,210,542 | A | 5/1993 | Pett et al. | |
| 5,220,335 | A | 6/1993 | Huang | |
| 5,231,406 | A | 7/1993 | Sreenivas | |
| 5,245,349 | A * | 9/1993 | Harada | 343/700 MS |
| 5,382,959 | A | 1/1995 | Pett et al. | |
| 5,384,557 | A | 1/1995 | Yoshida et al. | 333/21 A |
| 5,440,318 | A * | 8/1995 | Butland et al. | 343/814 |
| 6,188,367 | B1 | 2/2001 | Morrison et al. | 343/765 |
| 6,204,823 | B1 | 3/2001 | Spano et al. | |
| 6,288,677 | B1 | 9/2001 | Fink | 343/700 MS |
| 6,297,774 | B1 | 10/2001 | Chung | |
| 6,396,440 | B1 | 5/2002 | Chen | |
| 6,407,717 | B1 | 6/2002 | Killen et al. | |
| 6,421,012 | B1 | 7/2002 | Heckaman | |
| 6,452,550 | B1 | 9/2002 | Channabasappa et al. | |
| 6,473,057 | B1 | 10/2002 | Monzon | |
| 6,496,146 | B1 | 12/2002 | Chang et al. | |
| 6,538,612 | B1 | 3/2003 | King | 343/757 |
| 6,710,749 | B1 | 3/2004 | King | 343/757 |
| 6,788,258 | B1 | 9/2004 | Olson | 343/700 MS |
| 6,864,846 | B1 | 3/2005 | King | 343/757 |
| 2001/0050654 | A1 | 12/2001 | Killen et al. | |
| 2001/0055948 | A1 | 12/2001 | Ikeda et al. | |
| 2002/0067311 | A1 | 6/2002 | Wildey et al. | |
| 2002/0167449 | A1 | 11/2002 | Frazita et al. | |
| 2003/0011514 | A1 | 1/2003 | Kirchofer et al. | |
| 2003/0020663 | A1 | 1/2003 | Bolzer et al. | |

* cited by examiner

OTHER PUBLICATIONS

International Search Report.

*Primary Examiner*—Michael C. Wimer
(74) *Attorney, Agent, or Firm*—Foley Hoag LLP

(57) ABSTRACT

A stacked patch antenna has a first element having a feed thereto spaced above a ground plane and one or more spaced apart parasitic elements spaced above the first element. The first and parasitic elements may be tuned to a fundamental mode for radiation of a specified frequency. The geometric centers of the parasitic elements are offset from one another and from the geometric center of the first element along the same direction. The stacked patch configuration provides increased gain and bandwidth. The offset configuration determines the direction of maximum gain for the antenna. The first and parasitic elements can be single antenna elements and may be microstrip antenna elements. The elements can also be arrays of microstrip antenna elements. The phasing of the arrays of microstrip elements can be controlled to determine a gain sensitivity direction.

38 Claims, 4 Drawing Sheets

OFFSET STACKED PATCH ANTENNA AND METHOD

RELATED APPLICATIONS

This application is co-pending with related patent application No. 10/290,667 entitled "Feed Network and Method for an Offset Stacked Patch Antenna Array", by the same inventor and having assignee in common, each filed concurrently herewith, and incorporated by reference herein in its entirety.

FIELD

This application relates to the field of patch antennas, and more particularly to stacked patch antennas using offset multiple elements to control the direction of maximum antenna sensitivity.

BACKGROUND

Many satellite mobile communication applications require that the direction of maximum sensitivity or gain of a receiving antenna be adjusted; i.e., that the receiving antenna be directed towards the satellite and track the satellite while the vehicle is moving and turning.

Typically, in the continental United States television satellites may be between 30° and 60° above the horizon. In mobile satellite television applications, operating in a 12 GHz range, standard dish antennas may be mounted on the vehicle and mechanically rotated to the appropriate azimuth and tilted to the appropriate elevation to track the satellite.

While such systems may provide adequate signal acquisition and tracking, the antenna, tracking mechanism and protective dome cover may present a profile on the order of 15 inches high and 30 inches or more in diameter. This size profile may be acceptable on marine vehicles, commercial vehicles and large recreational vehicles, such as motor homes. However, for applications where a lower profile is desirable, a special low profile dish antenna, or a planar antenna element, or array of elements may be preferred. However, low profile dish antennas may only decrease overall height by two to four inches. Planar antennas suffer in that maximum gain may be orthogonal to the plane of the antenna, thus not optimally directed at a satellite, which may be 60° from that direction.

In a planar phased array antenna, a stationary array of antenna elements may be employed. The array elements may be produced inexpensively by conventional integrated circuit manufacturing techniques, e.g., photolithography, on a continuous dielectric substrate, and may be referred to as microstrip antennas. The direction of spatial gain or sensitivity of the antenna can be changed by adjusting the relative phase of the signals received from the antenna elements. However, gain may vary as the cosine of the angle from the direction of maximum gain, typically orthogonal to the plane of the array; and this may result in inadequate gain at typical satellite elevations. Attempts have been made to change the direction of maximum gain by arranging microstrip elements in a Yagi configuration. For example, see U.S. Pat. No. 4,370,657, "Electrically end coupled parasitic microstrip antennas" to Kaloi; U.S. Pat. No. 5,008,681, "Microstrip antenna with parasitic elements" to Cavallaro, et al.; and U.S. Pat. No. 5,220,335, "Planar microstrip Yagi antenna array" to Huang.

In another configuration described in "MSAT Vehicular Antennas with Self Scanning Array Elements," L. Shafai, Proceedings of the Second International Mobile Satellite Conference, Ottawa, 1990, and referred to herein as a dual mode patch antenna, an element tuned to a fundamental mode can be stacked above an element tuned to a second mode. To date, these attempts have had limited success as mobile communications antenna and have proved impractical as phased array antenna in general.

SUMMARY

An antenna having maximum gain at an angle with respect to a major axis, defined as the gain angle of the antenna, may comprise a substantially planar conductive ground plane element normal to the major axis, a substantially planar first antenna layer parallel to and having a first spaced apart relation from the ground plane element and comprising at least one first layer antenna element tuned to a fundamental mode for radiation of a specified frequency, for one or more of the said first layer antenna elements, at least one feed line connected thereto and at least one substantially planar additional layer, each additional layer parallel to and having a respective spaced apart relation from the first layer, each additional layer comprising at least one respective additional layer antenna element tuned to the fundamental mode, which respective additional layer antenna element corresponds to a specified first layer antenna element and has a respective offset relation from the specified first layer antenna element in a direction normal to the specified axis.

The antenna layers may be comprised of microstrip antenna elements arranged in corresponding arrays of antenna elements, with microstrip feeds thereto and having dielectric material disposed between the first antenna layer and the ground plane and between the layers. The arrays of antenna elements may be arranged in columns and rows and may be arranged to be substantially circular. The antenna elements may be fabricated of truncated circles having central axes parallel to truncated sides of the said elements and oriented such that the central axes of adjacent first layer antenna elements in a specified column which are connected to a specified feed line are rotated through 90° with respect to each other.

The antenna may set the phasing of adjacent elements of the array to obtain a gain sensitivity at an angle corresponding to the gain angle of the antenna. The antenna may be rotated and tilted to track to the direction and elevation of a satellite transmitter. The array of antenna elements may be a phased array to steer a spatial gain of the antenna to track the elevation.

The antenna may comprise at least one coaxial cable feed having an outer conductor connected to the ground plane element and having a center conductor connected to at least one of the feed lines. The respective additional layer antenna element offset relations from the corresponding first layer antenna element may increase as the respective additional layer spaced apart relations from the first layer increase.

In one embodiment, an antenna having maximum gain at a gain angle with respect to a specified axis of the antenna may comprise a substantially planar conductive ground plane element normal to the specified axis and a substantially planar first layer and at least one substantially planar additional layer, each layer comprising a plurality of microstrip truncated circle antenna elements having central axes parallel to truncated sides of the elements, the elements tuned to a fundamental mode for radiation of a specified frequency, the elements forming corresponding arrays of elements on the layers, each layer being parallel to and having a respective spaced apart relation from the ground plane element, each array of additional layer elements having a respective offset relation from the array of first layer elements in a direction normal to the specified axis, the offset relations increasing as the spaced apart relations increase.

A dielectric material may be disposed between the ground plane element and the first layer, between the first layer and one additional layer, and between successive additional layers when the antenna comprises more than one additional layer. The dielectric material can maintain the respective spaced apart relations between the layers. A microstrip feed network in a plane of the first layer may be connected to first layer antenna elements and phasing means may set a phasing of adjacent first layer antenna elements to provide a gain sensitivity at a specified angle relative to the specified axis of the antenna.

A method of providing a maximum gain of a stacked patch antenna at a gain angle with respect to a specified axis of the antenna may comprise placing a substantially planar first layer, comprising at least one first layer antenna element, parallel to and a first distance apart from a substantially planar conductive ground plane element normal to the specified axis, connecting a feed line to one or more of said first layer antenna elements, placing at least one substantially planar additional layer, parallel to and a specified distance apart from the first layer, each additional layer comprising at least one additional layer antenna element corresponding to a specified first layer antenna element and being offset a specified offset distance from the said specified first layer antenna element in a direction normal to the specified axis and tuning each first layer antenna element and each additional layer antenna element to a fundamental mode for radiation of a specified frequency.

The method may comprise laying down an array of microstrip first layer antenna elements on a first dielectric sheet, the first dielectric sheet maintaining the first distance between the ground plane element and the first layer and, for each additional layer, laying down an array of microstrip additional layer antenna elements on an additional dielectric sheet, the additional dielectric sheet maintaining the distance between the first layer and the additional layer. The method may further comprise integrated circuit manufacturing of the microstrip feed lines and laying down the arrays to form substantially circular arrays.

The method may comprise laying down the arrays to form columns and setting a phasing of first layer antenna elements in adjacent columns to provide a gain sensitivity at the gain angle. The antenna elements may be truncated circles having central axes parallel to truncated sides of the said elements, and the method may comprise orientating the first layer antenna elements such that the central axes of adjacent first layer antenna elements in a specified column which are connected to a specified feed line are rotated through 90° with respect to each other.

The method may comprise connecting an outer conductor of at least one coaxial cable feed to the ground plane element and connecting a center conductor of the at least one coaxial cable feed to at least one of the feed lines. The method may also comprise increasing the additional layer antenna element offset distances in the direction normal to the specified axis as the respective additional layer distances from the first layer increase.

BRIEF DESCRIPTION OF THE DRAWINGS

The following figures depict certain illustrative embodiments in which like reference numerals refer to like elements. These depicted embodiments are to be understood as illustrative and not as limiting in any way.

DETAILED DESCRIPTION OF CERTAIN ILLUSTRATED EMBODIMENTS

Figure 1:
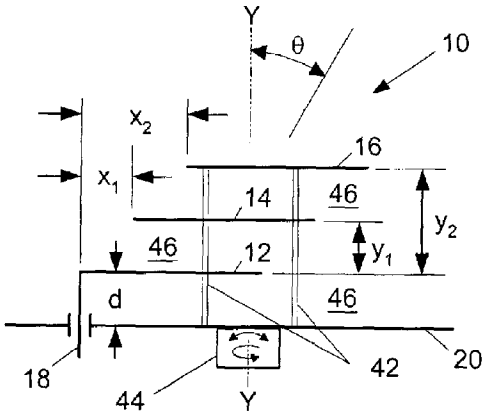
FIG. 1 is a schematic representation of an offset stacked patch antenna.

Referring now to FIG. 1, there is illustrated a schematic view of a stacked patch antenna 10. In the illustrative embodiment of FIG. 1, antenna 10 may include three antenna elements 12, 14 and 16. However, it can be understood that the number of elements is not limited to three and that two or more elements may be used. The antenna elements may be fabricated of metal, metal alloy, or other conducting materials as are known in the art. In one embodiment, the elements 12, 14 and 16 are preferably microstrip antenna elements. Microstrip antenna elements are known in the art and are planar metallic elements that are formed on a continuous dielectric substrate using conventional integrated circuit manufacturing techniques, e.g., photolithography. Other forms and fabrications of antenna elements known to those of ordinary skill in the art also may be employed.

It will be appreciated that elements 12, 14 and 16 are shown in a side view in FIG. 1, with the planar surfaces of elements 12, 14 and 16 extending orthogonally to the plane of FIG. 1. In the embodiment shown in FIG. 1, element 12 can have a feed 18 and may be tuned near a fundamental mode for the frequencies of interest. Element 12 may be maintained a distance d over, i.e., normal to, ground plane 20. Elements 14 and 16 are parasitic elements, i.e., elements without a feed, as are known in the art. In the context of the discussion herein, it can be understood that in general an antenna may operate in either a receiving or a transmitting mode. In a transmitting mode, the elements are powered through a feed, such as feed 18, and signals are radiated from the elements. In a receiving mode, such as in the embodiments described herein, signals picked up by the antenna elements are carried from the elements to receiving components via the feed.

Elements 14 and 16 can be spaced apart from element 12 at distances $y_1$ and $y_2$, respectively, in a direction normal to element 12. With respect to their geometric centers, elements 14 and 16 also can be offset distances $x_1$ and $x_2$, respectively, from the geometric center of element 12 within their respective planes. In one embodiment, elements 12, 14 and 16 can have substantially identical shapes and the spacings and offsets between elements can be substantially identical, such that $y_2 \cong 2*y_1$ and $x_2 \cong 2*x_1$. It can be understood that spacings and offsets may be varied to optimize performance of the antenna. Additionally, parasitic elements may differ in shape and size with respect to one another and with respect to element 12. However, the sizes and shapes of parasitic elements 14 and 16 may be such as to be near resonance with element 12.

Figure 2:
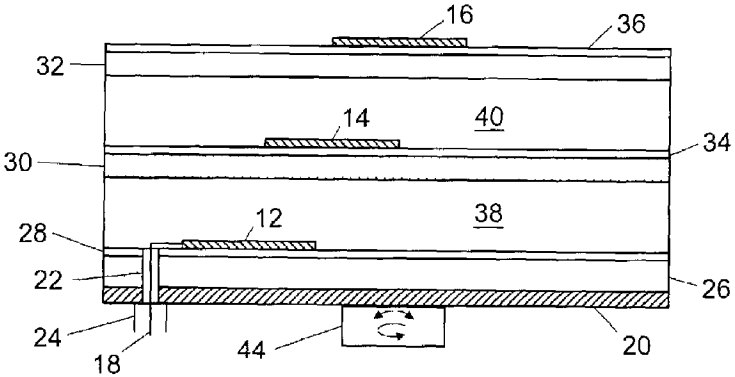
FIG. 2 is a cross sectional representation of an offset stacked patch antenna.

Referring now to FIG. 2, a cross sectional representation of a microstrip stacked patch antenna embodiment of antenna 10 is shown. Ground plane 20 is provided with opening 22 at which coaxial line 24 may be connected. Center conductor 18 of coaxial line 24 may pass through opening 22 to connect to element 12. It can be seen that conductor 18 may be run in the same plane as element 12 and may be formed using the same integrated circuit manufacturing techniques. Other forms of feed lines, as are known to those skilled in the art, may be used, e.g., element 12 may be fed through a slot in ground plane 20. Ground plane 20 may be a solid metallic plate, or may be a metallized dielectric plate. Other forms of electrical conductors at microwave frequencies, as are known in the art, may be used for ground plane 20, e.g., a wire grid.

In one embodiment, dielectric sheet 26 may be disposed on ground plane 20 and element 12 may be disposed on dielectric sheet 26. Alternatively, in the embodiment shown in FIG. 2, element 12 may be disposed on a separate support sheet 28. Similarly, elements 14 and 16 may be disposed on dielectric sheets 30 and 32, respectively, or may be disposed, as shown in FIG. 2, on separate support sheets 34 and 36, respectively. It is noted that support sheets 28, 34 and 36 may be fabricated of dielectric material. Dielectric spacers 38 and 40 may be disposed on elements 12 and 14 and may extend over elements 26 and 30, or elements 28 and 34, respectively, to maintain the spacings $y_1$ and $y_2$. In one embodiment, dielectric sheet 26 may be formed of a high density polyolefin material, dielectric sheets 30 and 32 may be formed of a thin film polyester material and spacers 38 and 40 may be formed of insulating material, e.g., expanded polystyrene. Other materials and manner of support known to those skilled in the art also may be used.

Figure 3:
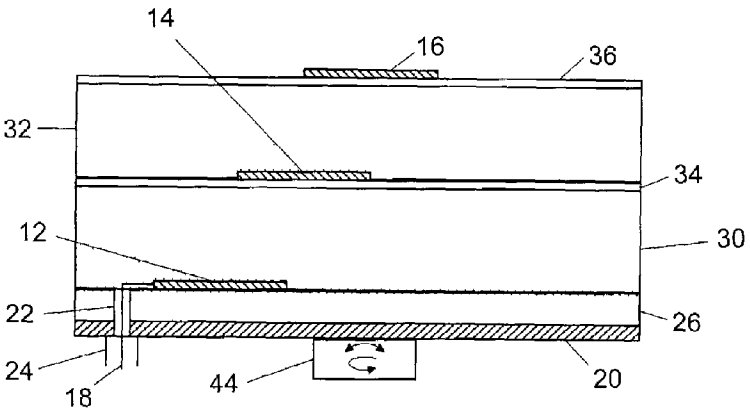
FIG. 3 is a cross sectional representation of another embodiment of an offset stacked patch antenna.

For example, spacers 38 and 40 may be incorporated with dielectric sheets 30 and 32, respectively, such that one single layer of dielectric material may be disposed between elements 12 and 14 and another single layer of dielectric material may be disposed between elements 14 and 16. FIG. 3 illustrates such an embodiment with element 12 disposed directly on dielectric sheet 26, dielectric sheet 30 extending to dielectric sheet 26 and dielectric sheet 32 extending to support layer 34.

It will be appreciated that embodiments having other than microstrip antenna elements can be fabricated. As an example, elements 12, 14 and 16 may be fabricated from plate material, similar to the metallic plate ground plane 20 described for the microstrip antenna of FIG. 2. Referring back to FIG. 1, the spacings and offsets between elements formed of plate material can be maintained by suitable supports, such as supports 42, that may not interfere with the radiation pattern of antenna 10. Design of such supports may follow guidelines known in the art. In such embodiments, dielectric sheets 26, 30 and 32, support sheets 28, 34 and 36 and spacers 38 and 40 (as described in relation to the microstrip element embodiment of FIG. 2) may be replaced by a layer of air between the layers, identified as 46 in FIG. 1.

Thus, it is evident that the means and methods for providing the spacings ($y_1$ and $y_2$) and the offsets ($x_1$ and $x_2$) can be chosen to suit the geometry and materials of stacked patch antenna 10 and particularly of elements 12, 14 and 16, in accordance with means and methods known in the art. In operation, the stacking, or spaced apart relationship, of parasitic elements 14 and 16 over element 12 may provide antenna 10 with broad bandwidth as may be known in the art. Additionally, the offsets between the elements may result in a maximum gain rotated from the direction orthogonal to the plane of the antenna elements as will be explained in further detail.

Referring to FIG. 1, it has been found that for an antenna having the configuration of stacked patch antenna 10 and with antenna element 12 tuned to near the fundamental mode, the resulting maximum gain direction may be at an angle θ with respect to an axis (Y-Y) orthogonal to the elements. The angle θ may depend on the spacing, offset and size of the antenna elements 12, 14 and 16. Conceptually, antenna 10 may be compared to a dual mode patch antenna. As is known, a dual mode patch antenna may consist of two elements, one directly above the other, without an offset. The upper element of a dual mode patch antenna may be tuned to a fundamental mode, while the lower element may be tuned to a second mode, with both elements having feed lines connected thereto. The resulting mode superposition can result in a direction of maximum gain rotated from the direction orthogonal to the plane of the antenna elements. However, this approach may require multiple feed points for each patch and for each sense of polarization, making it impractical as an antenna array element. Further, there may be no parameter available for rotating the direction of maximum gain other than that which is inherent to the approach. The limitation in rotation for this approach can be approximately 30° from the direction orthogonal to the plane of the antenna element.

The lower element, i.e., element 12 of stacked patch antenna 10 may have a feed 18 and be tuned to a fundamental mode. Unlike the dual mode patch antenna, antenna 10 may have layers of parasitic elements positioned above element 12 (e.g., layers 14 and 16 of FIGS. 1 and 2). By correctly choosing the spacings ($y_1$, $y_2$) and offsets ($x_1$, $x_2$) for a given size of the elements and frequency range, the superposition of the fundamental mode of element 12 and the parasitic fundamental modes of elements above the lower element, e.g., the fundamental modes of elements 14 and 16 of FIG. 1, can also result in a tilted direction of maximum gain. It is known in the art that direct mathematical design for unbounded radiating structures, such as elements 12, 14 and 16, may not be feasible. Such structures may best be characterized using mathematical modeling algorithms and computer simulations as are available to those in the art, such as method of moments, or finite element modeling.

Figure 4:
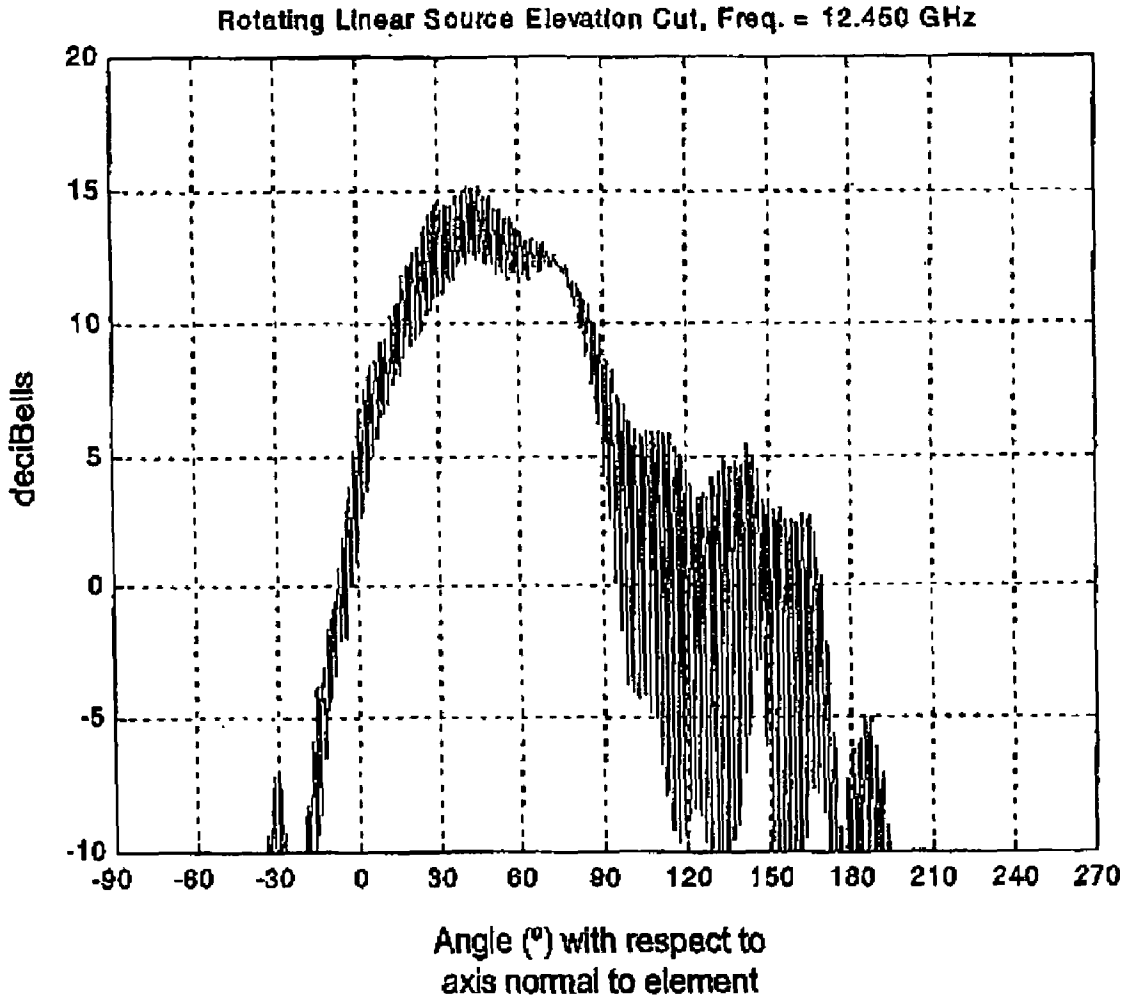
FIG. 4 is a gain pattern diagram for an offset stacked patch antenna.

As an example of such a design, an offset stacked patch antenna (referred to hereafter as Example 1) may be constructed with circular elements 12, 14 and 16 having diameters in the range of 0.30 inches, a stacking height between elements in the range of 0.12 inches and an offset between neighboring elements in a range of 0.18 inches. The element diameter may vary so as to correspond with (i.e., be tuned to) a desired frequency response, as is known in the art. The diameter chosen for the Example 1 antenna may correspond to a frequency of 12.45 GHz so as to receive broadcast signals from a television satellite. It is known, however, that stacking of elements may increase gain and bandwidth, such that the antenna of Example 1 may be operable in a range of between about 8 GHz and about 16 GHz. Based on the above relationships, the Example 1 antenna so constructed may have direction of maximum gain tilted at an angle θ in a range of about 45° with respect to an axis orthogonal to the plane of the antenna elements. FIG. 4 shows a gain pattern for the beam of an antenna at 12.45 GHz. The antenna on which FIG. 4 is based may have the general configuration of the Example 1 antenna, however, the elements may be truncated circles in lieu of the full circles as described for the Example 1 antenna. It will be understood that element shapes, sizes, stack heights and offsets may be varied in accordance with the above described design methods for such structures so as to obtain desired frequencies and to provide beam angles θ in a range of up to about 60°.

The tilted gain of antenna 10 can be of use in a variety of applications. Such an antenna may be advantageously utilized in mobile communications applications. As can be seen by the above Example 1, antenna 10 may be fabricated with a total height on the order of less than 1.0 cm, considering stack heights and the thickness of ground plane 20 and dielectric sheet 26.

Tracking of geosynchronous communications satellites, such as television satellites, from moving platforms within the continental United States may require an antenna to acquire a signal at elevations from about 30° to 60°. For the antenna of Example 1, this may require a ±15° tilt to aim the antenna of Example 1 at the satellite. When antenna tilting and rotation mechanisms, such as mechanism 44 of FIGS. 1 and 2, are considered, the total thickness for an antenna as in Example 1 capable of acquiring and tracking such a satellite from a moving vehicle may be on the order of 4 inches. In comparison with previously identified antennas, the antenna of Example 1 may provide greater than a twofold reduction in height.

Figure 5:
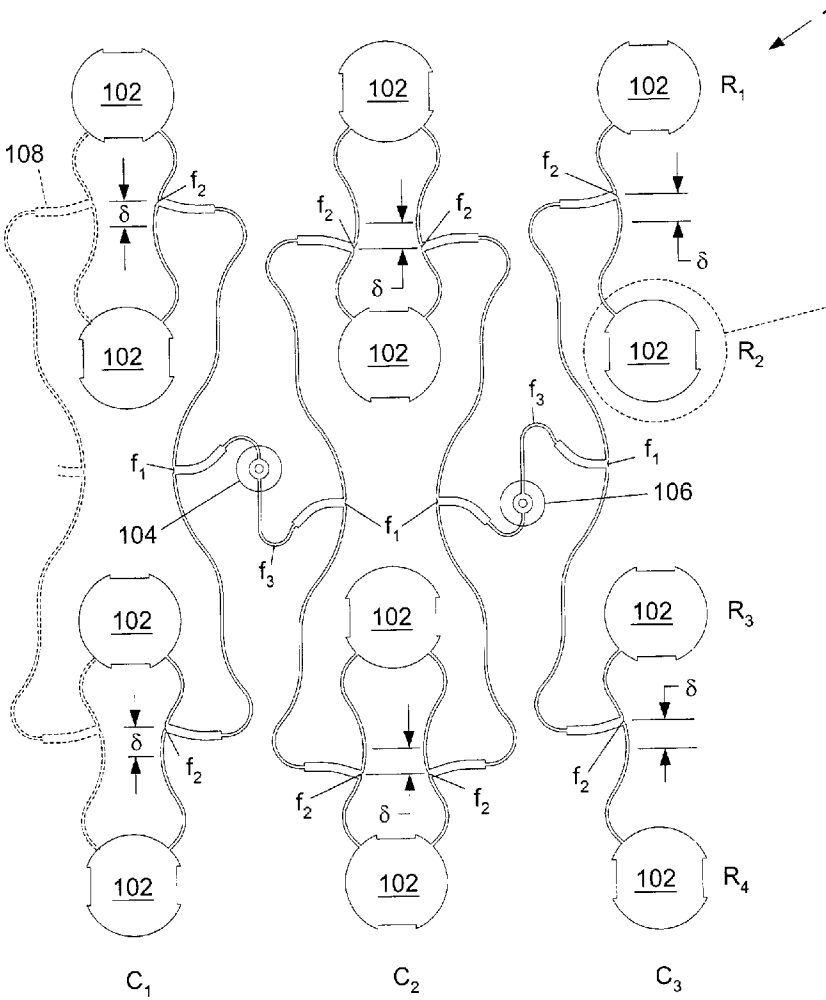
FIG. 5 is a top view of a group of patch antenna elements illustrating a portion of an antenna receiving network.

FIG. 5 illustrates the base layer of a subassembly of antenna elements that can be advantageous in constructing antennas for satellite television reception in a moving vehicle. Array 100 may be a four row by three column array of antenna elements 102, though other configurations of rows and columns may be used. It may be noted that dashed line portions of FIG. 5 are not part of the four by three subassembly of FIG. 5 and may reflect connections to incorporate the subassembly of FIG. 5 into a larger array, as will be described in relation to FIG. 8.

Television signals may be broadcast from two satellites co-located in geosynchronous orbit. The signals may be circularly polarized, with one satellite signal being right hand circularly polarized and the other left hand circularly polarized. Elements 102 may have a truncated circular shape, as shown in FIG. 5, which may have application where circular polarization may be used, though elements having other shapes may be used. It may be noted that an element 102 may correspond to element 12 in FIGS. 1 and 2.

Figure 6:
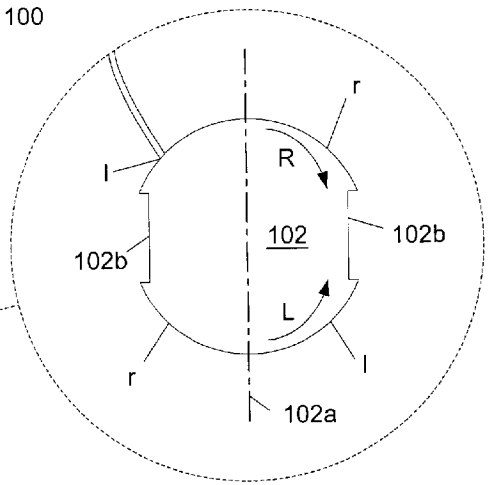
FIG. 6 is a detailed view of one of the elements of FIG. 5.

FIG. 6 shows a detailed view of an element 102, having a central axis 102*a* parallel to the truncated sides 102*b* of element 102. Considering a viewpoint looking from the center of element 102 along the axis 102*a* and outward from the center of element 102, it can be seen that a truncated circular element, such as element 102, may have a feed point to the right of axis 102*a*, such as at one of the points labeled r in FIG. 6, or a feed point to the left of axis 102*a* of element 102, such as at one of the points labeled l in FIG. 6.

If the feed point is to the right of axis 102*a*, the signal from element 102 can be right hand circular (RHC) polarized, as depicted by arrow R. Similarly, if the feed point is to the left of axis 102*a*, the signal from element 102 can be left hand circular (LHC) polarized, as depicted by arrow L. Thus, the network of FIG. 5 may be seen to provide an antenna array capable of receiving both RHC and LHC polarized signals from the co-located satellites, as the antenna elements 102 of array 100 may have both right and left feed point locations with respect to the viewpoint described previously. Additionally, it may be known that a phase shift of 180° may be provided between one of the feeds labeled r and the other feed labeled r, or between one of the feeds labeled l and the other feed labeled l.

Similarly, by appropriate choice of element shape and feed points, one can obtain any two mutually orthogonal polarizations, such as dual-linear or dual-elliptical polarizations.

Referring back to FIG. 5, it can be seen that elements 102 having common feed 104 may receive RHC polarized signals and elements 102 having common feed 106 may receive LHC polarized signals. It is noted that elements 102 between common feeds 104 and 106, i.e. elements of the column designated $C_2$ in FIG. 5, may receive RHC or LHC polarized signals depending on whether the signal is received through common feed 104 or common feed 106, respectively.

In reference to common feed 104, the signals from element 102 at row $R_1$, column $C_1$ (1,1), and from element 102 at row $R_3$, column $C_1$ (3,1) can be in phase as they may have identical feed lengths and orientation, the feed being from element 102 to $f_2$, to $f_1$ and to common feed 104. The longer feed length from elements (2,1) and (4,1), as shown by offsets δ, can result in a 90° phase shift for the signals from elements (2,1) and (4,1) relative to the signals from elements (1,1) and (3,1). However, the −90° rotation of elements (2,1) and (4,1) with respect to elements (1,1) and (3,1) can result in the signals from the elements of column C being in phase with one another with respect to common feed 104.

Figure 7:
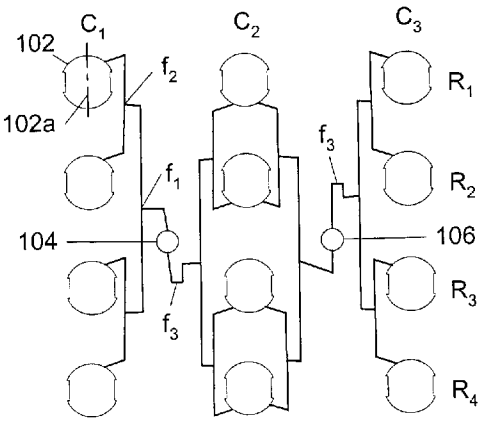
FIG. 7 is a top view of a group of patch antenna elements illustrating another embodiment of a portion of a feed network.

In the embodiment of FIG. 7, the elements 102 may not be rotated, i.e., the axes 102*a* of the elements 102 can be parallel. In this embodiment, the elements in a column may have the same feed orientation, thus the lengths of the feeds from the elements 102 to $f_2$ may be the same for each element 102 and offset δ may be zero. As with the embodiment of FIG. 5, the element orientation and feed lengths shown in FIG. 7 can result in the elements of column $C_1$ being in phase with one another.

In the embodiments of FIGS. 5 and 7, it can easily be seen that the signals from the elements of column $C_2$ with respect to common feed 104 can be similarly in phase with one another. Looking now at elements 102 of column $C_2$ in relation to elements 102 of column $C_1$, the added feed length resulting from the jog at $f_3$ can result in a 66.5° phase shift for the signals from elements 102 of column $C_2$ as compared to the elements 102 of column $C_1$. Considering feed 104, elements 102 of column $C_2$ may have a 180° rotation from corresponding elements 102 of column $C_1$. (Compare, for example, elements (2,2) and (1,1) having diametrically opposed feeds.) Thus, the 66.5° phase shift resulting from the differing feed lengths and the 180° phase shift resulting from the rotation may result in a total phase shift of 246.5° between the signals from the elements of column $C_1$ and the signals from the elements of column $C_2$ with respect to common feed 104.

It can be seen from FIGS. 5 and 7, that elements 102 in columns $C_2$ and $C_3$ have feed lengths and rotations with respect to common feed 106 analogous to those of the elements 102 of columns $C_1$ and $C_2$ with respect to common feed 104. Thus, the differences in feed lengths and rotations of the elements 102 of column $C_3$ with respect to the elements 102 of column $C_2$ can result in an analogous 246.5° phase shift in the signals from the elements 102 of column $C_3$ as compared to the elements 102 of column $C_2$, with respect to common feed 106.

It is known in the art that adjusting the relative phase between signals from antenna elements in an array of elements can result in shifting the spatial gain orientation of the antenna. It is further known that the phase progression between columns, such as between $C_1$ and $C_2$, can be calculated from the expression $$\text{Relative Phase} = \left(\frac{360d}{\lambda}\right)\sin(\theta_0),$$

where d is the spacing between columns, λ is the operating wavelength and $\theta_0$ is the desired scan angle. For example, if the operating frequency is 12.45 GHz, i.e., λ=0.948 inches, the spacing d=0.91725 inches between columns, and the desired scan angle $\theta_0$=45°, then phase may be 246.5°. Thus, a progressive phase shift or relative phase of 246.5° between signals from antenna elements in an array can result in a 45° spatial gain orientation and the feed network of FIG. 5 can provide a direction of spatial gain or sensitivity at a 45° angle from the vertical for both RHC and LHC polarized signals. It can be seen that by altering the feed lengths other phase shifts may be obtained.

To optimally track the co-located television satellites at elevations of from 30° to 60°, array 100 may need to tilt on the order of ±15°, (i.e., 45°–30°, or 45°–60°). When compared to an antenna with a spatial gain or sensitivity in the vertical direction, i.e., normal to the plane of the antenna, which requires a 60° tilt to track a satellite at a 30° elevation, the 45° direction of spatial gain orientation of array 100 can result in a substantial decrease in height requirements.

In a phased array of conventional patch elements, in which the maximum gain is directed normal to the plane of the element, the gain, if phase scanned, may have a functional dependence on scan angle $\theta_0$ in proportion to cosine$^n$ ($\theta_0$), where n is typically greater than 2 for conventional patch elements. In a phased array using stacked patch elements as shown in FIGS. 1 and 2, such as array 100, in which the maximum gain may be directed at an angle θ away from normal to the plane of the element, the gain if phase scanned may have a functional dependence on scan angle $\theta_0$ in proportion to cosine$^n$($\theta_0$-θ), facilitating a benefit to array gain at scan angles $\theta_0$ around θ. As an illustration, a conventional phased array scanned to 45° may have a gain of about 70% compared to the gain of array 100, in which the maximum gain of the patch elements 102 is prescanned to 45° by proper offset and spacing of the parasitic elements 14 and 16.

Thus, the direction of gain sensitivity resulting from the 246.5° phase shift of the feed network of FIG. 5 may correspond with the direction of maximum gain resulting from the offset, stacked patch configuration, so as to enhance signal acquisition at an angle of 45° from the plane of the antenna. Offset, stacked patch antennas having a base array 100 with a feed network as shown in FIG. 5 and having two corresponding parasitic arrays of elements spaced and offset in the manner of FIGS. 1 and 2 and the antenna of Example 1, can provide planar, low height antennas with maximum gain at an angle of 45° with respect to an axis orthogonal to the plane of the antennas. It can be appreciated by those of skill in the art, that maximum gain angles and phase shifts can be optimized for tracking satellites at other elevations, i.e., corresponding to other coverage areas besides the continental United States.

Figure 8:
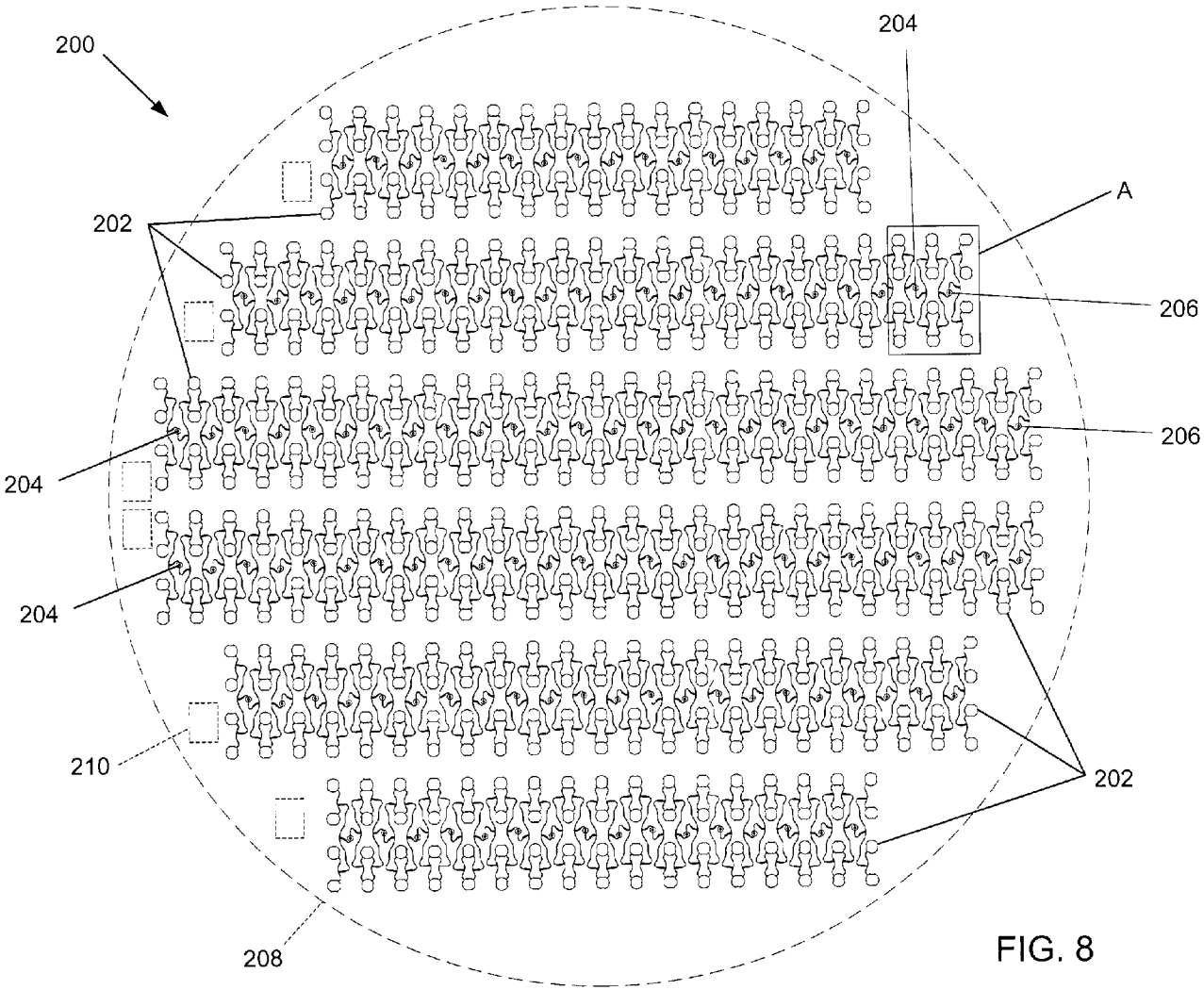
FIG. 8 is a top view of a phased array of patch antenna elements.

Referring now to FIG. 8, there is shown a top view of a phased array 200 of antenna elements 202, which, together with corresponding parasitic arrays (not shown), may be configured to provide maximum gain at 45° as described above. (For clarity, only one element per row is identified in FIG. 8.) It can be seen that array 200 may be configured of multiple iterations of the subassembly of FIG. 5 (as indicated within outline A in FIG. 8), with the connections 108, shown as dashed lines in FIG. 5, completed between additional columns of elements 202 in order to complete the feed networks. Thus, with respect to one of the common feeds 204 or 206, corresponding respectively to common feeds 104 and 106 of FIG. 5, array 200 may have the same feed network configuration as shown for array 100, with the network configuration of array 100 simply extended to accommodate additional columns of elements.

For the embodiment of FIG. 8, six rows of the extended feed network and additional columns of elements can be provided. In the embodiment of FIG. 8, array 200 can be arranged to fit within a circular shape (shown in phantom as shape 208) so as to minimize the rotation footprint of the array 200. In order to accommodate the circular shape 208, the number of columns of elements within the rows may vary. The rows as shown in FIG. 8, may include 17, 23 and 27 columns of elements. It is understood that shapes containing the array 200 and configurations and numbers of rows and columns of elements in array 200 are not limited to those indicated in FIG. 8. The shapes, configurations and numbers of rows and columns of elements may be varied as is known in the art to suit the geometry and frequency requirements of a desired application.

Acquisition and tracking of RHC and LHC polarized television satellites having an elevation in a range of about 30° to 60° can be accomplished by mechanically tilting array 200 at an angle of up to about ±15°. When mounted on a vehicle, the array may require further mechanical tilting to compensate for the tilt of the vehicle.

While means and methods for accomplishing the proper tilt and rotation of the antenna of FIG. 8 are known, the mechanism could be simplified and the height required reduced if tilting is not required. This may be accomplished by the use of phased array technology as is known in the art. As noted, a 246.5° phase shift between adjacent columns, e.g., $C_1$ and $C_2$ of FIG. 5, of elements can be obtained with the feed network of arrays 100 and 200 so as to provide a spatial gain or sensitivity at 45°. By varying the phase shift, the spatial gain may be steered through a variety of angles, including those that may provide tracking of the aforementioned satellites. Given that the maximum gain for the offset stacked patch antenna is at 45° and that the satellites have an elevation in a range of about 30° to 60°, a steering angle of ±15° with respect to maximum gain may be required for acquisition of the satellite.

Considering possible vehicle tilt caused by terrain or vehicle maneuvers, a total steering range of about ±20° may be required to track the satellite from a moving vehicle. Because the offset stacked patch configuration disclosed herein can provide an array element which has superior gain over the required coverage range, an array which utilizes such offset stacked patch elements will have performance superior to that achieved by an array of elements having maximum gain normal to the plane of the array. The gain achievable with the array of offset stacked elements will approach the theoretical limit represented by the projected area of the array in the direction of scan. Thus a phased array antenna wherein the phase shift can be varied to steer the spatial gain in elevation and wherein the antenna can be mechanically rotated in direction can be advantageous in tracking a satellite from a moving vehicle.

In order to vary the phasing of array 200, and thus to adjust the angle of spatial gain or sensitivity, a network of phase shifters 210 (shown in phantom in FIG. 8) may provide the necessary phase delays at common feeds 204, 206 (only some of which are identified for clarity) of array 200. Such phase shifters and their methods of use for controlling uniform progressive phase may be known to those of skill in the art.

While the systems and methods have been disclosed in connection with the illustrated embodiments, various modifications and improvements thereon will become readily apparent to those skilled in the art. For example, those skilled in the art may recognize that, in addition to use with circularly polarized signals as provided by television satellites directed to the continental United States, the system and method may also find use with dual linearly polarized signals as used with satellites in Europe. The materials for, and sizing of the antenna elements and other components of the arrays and antennas described herein may be varied in accordance with the guidelines herein provided depending on frequencies, power levels, acquisition directions and properties desired. Accordingly, the spirit and scope of the present methods and systems is to be limited only by the following claims.

What is claimed is:

1. An antenna having maximum gain at a gain angle with respect to a specified axis of the antenna, the antenna comprising:

a substantially planar conductive ground plane element normal to the specified axis;

a substantially planar first layer, parallel to and having a first spaced apart relation from the ground plane element, said first layer comprising an array of antenna elements wherein each of at least a plurality of the first layer antenna elements is tuned to a fundamental mode for radiation of a specified frequency, a plurality of the antenna elements being so positioned with respect to one another that isotropic radiation from those elements' positions at the specified frequency would exhibit grating lobes;

at least one substantially planar additional layer, each said additional layer parallel to and having a respective maintained spaced apart relation from the first layer, each said additional layer comprising an array of antenna elements wherein each of at least a plurality of the respective additional layer antenna elements is tuned to the fundamental mode, corresponds to a specified first layer antenna element, and is maintained so offset from said specified first layer antenna element in a direction normal to the specified axis as to form therewith a composite antenna element whose antenna pattern exhibits a maximum in a direction offset from normal to the ground plane; and phasing elements for so applying different phases to adjacent elements of the first array that the composite antenna element's antenna pattern exhibits relative attenuation in some said grating lobes' directions.

2. The antenna of claim 1, wherein each first layer antenna element and each additional layer antenna element is a microstrip antenna element.

3. The antenna of claim 2, wherein each feed line comprises a microstrip feed in a plane of the first layer.

4. The antenna of claim 1, wherein the first layer antenna elements and the additional layer antenna elements are arranged so that the first layer antenna element array and the additional layer antenna element arrays each are comprised of a plurality of rows and a plurality of columns of antenna elements.

5. The antenna of claim 1, wherein the first layer antenna elements and the additional layer antenna elements are arranged so that the first layer antenna element array and the additional layer antenna element arrays are substantially circular.

6. The antenna of claim 1, wherein the phasing elements are operable to vary the angle of maximum gain.

7. The antenna of claim 4, wherein the first layer antenna elements and the additional layer antenna elements comprise truncated circles having central axes parallel to truncated sides of the said elements.

8. The antenna of claim 7, wherein a plurality of first layer antenna elements is connected to each feed line, and the said first layer antenna elements are oriented such that the central axes of adjacent first layer antenna elements in a specified column which are connected to a specified feed line are rotated through 900° with respect to each other.

9. The antenna of claim 1, further comprising a dielectric material disposed on the ground plane element, the first layer antenna elements being disposed on the said dielectric material, the said dielectric material maintaining the first spaced apart relation.

10. The antenna of claim 9, further comprising additional dielectric material disposed between the first layer and one additional layer, and between successive additional layers when the antenna comprises more than one additional layer, the additional dielectric material maintaining the respective spaced apart relations from the first layer for the respective additional layers.

11. The antenna of claim 10, wherein the first layer antenna elements and the additional layer antenna elements comprise truncated circles having central axes parallel to truncated sides of the said elements.

12. The antenna of claim 11, wherein the phasing elements are operable to vary the angle of maximum gain.

13. The antenna of claim 11, wherein the first layer antenna elements and the additional layer antenna elements are arranged so that the first layer antenna element array and the additional layer antenna element arrays each are comprised of a plurality of rows and a plurality of columns of antenna elements.

14. The antenna of claim 13, wherein a plurality of first layer antenna elements is connected to each feed line, and the said first layer antenna elements are oriented such that the central axes of adjacent first layer antenna elements in a specified column which are connected to a specified feed line are rotated through 90° with respect to each other.

15. The antenna of claim 1, further comprising a rotation mechanism to rotate the antenna with respect to the specified axis.

16. The antenna of claim 1, further comprising a tilting mechanism to tilt the antenna by changing the orientation of the specified axis.

17. The antenna of claim 1, further comprising at least one coaxial cable feed having an outer conductor connected to the ground plane element and having a center conductor connected to at least one of the feed lines.

18. The antenna of claim 1, wherein the respective additional layer antenna element offset relations from the corresponding first layer antenna element increase as the respective additional layer spaced apart relations from the first layer increase.

19. An antenna having maximum gain at a gain angle with respect to a specified axis of the antenna, the antenna comprising:

a substantially planar conductive ground plane element normal to the specified axis;

a substantially planar first layer and at least two substantially planar additional layers, each layer comprising a plurality of microstrip truncated circle antenna elements having central axes parallel to truncated sides of the elements, the said elements tuned to a fundamental mode for radiation of a specified frequency, the said elements forming corresponding arrays of elements on the layers, each layer being parallel to and having a respective maintained spaced apart relation from the ground plane element, each array of additional layer elements being fixedly assembled into a respective offset relation from the array of first layer elements in a direction normal to the specified axis, the offset relations increasing as the spaced apart relations increase so that each of a plurality of the elements in the first layer cooperates with a corresponding element in each of the additional layers to form a composite element that is so spaced from the other composite elements that isotropic radiation from the composite element's locations at the specified frequency would exhibit grating lobes;

dielectric material disposed between the ground plane element and the first layer, between the first layer and one additional layer, and between successive additional layers when the antenna comprises more than one additional layer, the dielectric material maintaining the respective spaced apart relations between the layers;

a microstrip feed network in a plane of the first layer, wherein first layer antenna elements are connected to the feed network; and phasing elements for so applying different phases to adjacent elements of the first array that the composite antenna element's antenna pattern exhibits relative attenuation in some said grating lobes' directions.

20. The antenna of claim 19, wherein the first layer antenna elements and the additional layer antenna elements are arranged so that the first layer antenna element array and the additional layer antenna element arrays are substantially circular.

21. The antenna of claim 20, further comprising a rotation mechanism to rotate the antenna with respect to the specified axis and a tilting mechanism to tilt the antenna by changing the orientation of the specified axis.

22. The antenna of claim 19 wherein the microstrip feed network provides at least a portion of the phasing elements.

23. A method of providing a maximum gain of a stacked patch antenna at a gain angle with respect to a specified axis of the antenna, comprising:

providing a substantially planar first layer, comprising an array of microstrip first layer antenna elements, by laying the array down on a first dielectric sheet that keeps the first layer antenna elements parallel to and a first distance apart from a substantially planar conductive ground plane element normal to the specified axis;

connecting a feed line to each of a plurality of said first layer antenna elements;

providing at least one substantially planar additional layer, parallel to and a specified distance apart from the first layer, each additional layer comprising a plurality of additional layer antenna elements corresponding to respective ones of the specified first layer antenna elements, by laying down an array of microstrip additional layer antenna elements on an additional dielectric sheet that keeps the additional layer antenna elements in a fixed offset distance from the corresponding first layer antenna elements in a direction normal to the specified axis so that each of a plurality of the elements in the first layer cooperates with a corresponding element in each additional layer to form a composite element that is so spaced from the other composite elements that isotropic radiation at the specified frequency from the composite elements' locations would exhibit grating lobes;

tuning each first layer antenna element and each additional layer antenna element to a fundamental mode for radiation of a specified frequency; and providing phasing elements for so applying different phases to adjacent ones of first layer elements that the composite antenna element's antenna pattern exhibits relative attenuation in some said grating lobes' directions.

24. The method of claim 23, wherein the feed lines are microstrip feed lines, further comprising integrated circuit manufacturing of the said microstrip feed lines.

25. The method of claim 23, wherein laying down the arrays of antenna elements comprises laying down the antenna elements on the dielectric sheets to form substantially circular arrays.

26. The method of claim 23, wherein:

laying down the arrays of antenna elements comprises laying down the antenna elements on the dielectric sheets to form columns; and the phasing elements apply the same phase to elements in the same column.

27. The method of claim 23, wherein laying down the arrays of antenna elements comprises laying down the antenna elements on the dielectric sheets to form truncated circles having central axes parallel to truncated sides of the said elements.

28. The method of claim 27, wherein laying down the first layer antenna element array comprises laying down the first layer antenna elements oriented such that the central axes of adjacent first layer antenna elements in a specified column which are connected to a specified feed line are rotated through 90° with respect to each other.

29. The method of claim 23, further comprising connecting an outer conductor of at least one coaxial cable feed to the ground plane element and connecting a center conductor of the said at least one coaxial cable feed to at least one of the feed lines.

30. The method of claim 23, further comprising increasing the additional layer antenna element offset distances in the direction normal to the specified axis as the respective additional layer distances from the first layer increase.

31. An antenna having maximum gain with respect to a specified axis of the antenna, the antenna comprising:

a substantially planar conductive ground plane element normal to the specified axis;

a substantially planar first layer, parallel to and having a first spaced apart relation from the ground plane element, said first layer comprising a plurality of first layer antenna elements of which each is tuned to a fundamental mode for radiation of a specified frequency; and, at least one substantially planar additional layer, each said additional layer parallel to and having a respective maintained spaced apart relation from the first layer, each said additional layer comprising a plurality of respective additional layer antenna elements tuned to the fundamental mode, corresponding to a specified first layer antenna element, and maintained in a respective fixed-offset relation from said specified first layer antenna element in a direction normal to the specified axis to form therewith a composite antenna element whose antenna pattern exhibits a maximum in a direction offset from normal to the ground plane, a plurality of the composite antenna elements being so positioned with respect to one another that isotropic radiation from those elements' positions at the specified frequency would exhibit grating lobes; and phasing elements for so applying different phases to adjacent composite antenna elements that the composite antenna element's antenna pattern exhibits relative attenuation in some said grating lobes' directions;

wherein each said composite antenna element provides maximum gain at about 45° with respect to the specified axis of the antenna.

32. The antenna of claim 31, wherein each first layer antenna element and each additional layer antenna element is a microstrip antenna element.

33. The antenna of claim 32, wherein each feed line comprises a microstrip feed in a plane of the first layer.

34. The antenna of claim 31, wherein the first layer antenna elements and the additional layer antenna elements are arranged so that the first layer array and the additional layer arrays each comprise a plurality of rows and a plurality of columns of antenna elements.

35. The antenna of claim 34, wherein the phasing elements apply different phases to adjacent columns to provide a maximum gain of about 45° relative to the specified axis of the antenna.

36. The antenna of claim 31, further comprising a dielectric material disposed on the ground plane element, the first layer antenna elements being disposed on the said dielectric material, the said dielectric material maintaining the first spaced apart relation.

37. The antenna of claim 36, further comprising additional dielectric material disposed between the first layer and one additional layer, and between successive additional layers when the antenna comprises more than one additional layer, the additional dielectric material maintaining the respective spaced apart relations from the first layer for the respective additional layers.

38. The antenna of claim 31, wherein the respective additional layer antenna element offset relations from the corresponding first layer antenna element increase as the respective additional layer spaced apart relations from the first layer increase.

* * * * *